United States Patent [19]

Watanabe et al.

[11] Patent Number: 4,943,206

[45] Date of Patent: Jul. 24, 1990

[54] AUTOMATIC CARTON SUPPLY METHOD

[75] Inventors: Masao Watanabe, Hachioji; Shuri Mizoguchi, Kunitachi; Satoshi Kawai, Sagamihara; Kiyohiko Takahashi, Sagamiko; Toyokiti Tanimura, Akishima, all of Japan

[73] Assignee: Konica Corporation, Tokyo, Japan

[21] Appl. No.: 364,272

[22] Filed: Jun. 12, 1989

[30] Foreign Application Priority Data

Jun. 16, 1988 [JP] Japan ..... 63-149487
Jun. 16, 1988 [JP] Japan ..... 63-149488

[51] Int. Cl.[5] ..... B65B 25/02

[52] U.S. Cl. ..... 414/786; 414/416; 53/260

[58] Field of Search ..... 414/404, 416, 417, 27, 414/796.2, 786; 53/247, 260; 209/608

[56] References Cited

U.S. PATENT DOCUMENTS 1,053,283 2/1913 Duncan ..... 209/608
2,574,394 11/1951 Isler ..... 414/417 X
2,642,285 6/1953 Baker et al. ..... 271/149
2,665,694 1/1954 Mooers et al. ..... 209/608
3,819,057 6/1974 Cato ..... 414/27 X
3,902,662 9/1975 Oushige et al. ..... 209/608 X
4,306,826 12/1981 Detwiler ..... 414/27
4,555,213 11/1985 Tamura et al. ..... 414/417 X

*Primary Examiner*—Robert J. Spar
*Assistant Examiner*—William M. Hienz
*Attorney, Agent, or Firm*—Finnegan, Henderson, Farabow, Garrett, and Dunner

[57] ABSTRACT

A method of supplying cartons to a carton-packaging machine, comprising the steps of providing flattened cartons stacked in a line in a container package so that two cutouts on the cartons are lined to form two grooves on two parallel sides of the cartons; inserting two bar-shaped forks into the grooves respectively in the stacking direction of the cartons; pressing the cartons to be together along the inserting direction of the bar-shaped forks by pressers, which are adjustable for a different stacking amount of the cartons, so that the cartons are placed at the central portion of the bar-shaped forks; pulling out the cartons from the package with the bar-shaped forks; and supplying the cartons to the carton-packaging machine with the bar-shaped forks.

1 Claim, 11 Drawing Sheets

AUTOMATIC CARTON SUPPLY METHOD

BACKGROUND OF INVENTION

This invention relates to a method of loading efficiently a carton-packaging machine with small-box packaging cartons which are folded, arranged in a line at least, piled up and placed in a packaging case.

As shown in FIGS. 18 and 19, conventionally, small-box packaging cartons 3 were folded flat, piled up in a line in a unit of 200 to 250 pieces as shown by the numeral 5, arranged in 4 rows, 2 layers, placed in a packaging case and packaged, carried near a carton-packaging machine, and unpacked; and each row of the cartons was taken out and loaded into the supply unit of the carton-packaging machine by hand.

The carton-packaging machine unfolded cartons into a square pillar form so that the object to be packaged was inserted easily while feeding the folded cartons one by one according to the object to be packaged. After inserting the object to be packed, the flap of the carton was closed and glued to complete the individual packaging process and the cartons were collected as they were or wrapped or packaged collectively in specified multiple units.

For the conventional method such as above described, when unpacking and loading the carton-packaging machine with cartons, someone should attend it. Especially in recent high-speed carton-packaging machines, collected cartons should be supplied in a time shorter than a minute, requiring considerable labor of the person who supplies and loads the cartons; one person is not enough for such work. Therefore, if the packing case of collected cartons 2 is unpacked and placed in a specified place, and a handling unit grasps each row of the collected cartons and carries them to a carton-packaging machine, the labor to supply them may be omitted.

A container of exclusive use is possible to be provided for doing it only, but large dimensions and weight is required for the container which is difficult to handle and offers low workability. In addition, a carton manufacturing plant and a cartoning plant equipped with carton-packaging machines are generally at far distances from each other. To cause a container of fixed form to go and return between them, the container should return carrying empty cases like carrying air. This is non-productive transportation.

A method of using a collapsible container may be considered for this purpose but it should be large in weight and complicated in form. Difficulties in handling and operating are unavoidable and high cost will be required.

The object of this invention is to solve the subjects including such problems and offer a method of supplying cartons automatically to cartoning machines more positively, cheaply, and efficiently by using throwaway packing cases in which collected cartons are loaded and packed.

SUMMARY OF THE INVENTION

The above-described object is attained by (1) an automatic carton supply method that 2 bar-shape fork members are inserted through a slit provided in a packing case into a gap of a flap provided on both sides of multiple cartons which are folded flat, arranged in a line at least in one direction and collected up, and enhoused in a packing case, the said cartons is received by the above-described gap on both sides, and a carton pushing member pushes the cartons towards the center in the collecting direction and adjusts the gap corresponding to the collected quantity at both edges in the collecting direction of the said cartons, thus grasping up the above-described collected cartons, carrying them to a specified position and supplying; or (2) an automatic carton supply method that L-shaped tip of a chuck member composed of 2 grasping plates with at least one tip bent in an L-shape, or center side of 2 bent bar-shape members with both end pieces bent in U-shape connected with movable pieces, which is inserted into the gap of flaps provided on both sides of multiple cartons which are folded flat, arranged and collected at least in a row in one direction, and placed in a packing case to grasp the said cartons from both sides, and a carton pressing member presses cartons towards the center in the collecting direction being provided respectively at both ends in the carton collecting direction and a spacer to guide the insertion of the said pushing member being provided on the inside of the above-described packing case, thus grasping the above-described collected cartons and carrying and supplying to a specified position.

DETAILED DESCRIPTION OF THE INVENTION

The first embodiment using the method according to this invention will be explained below referring to FIGS. 1 to 3. However, this invention is not limited to these conditions.

Figure 1:
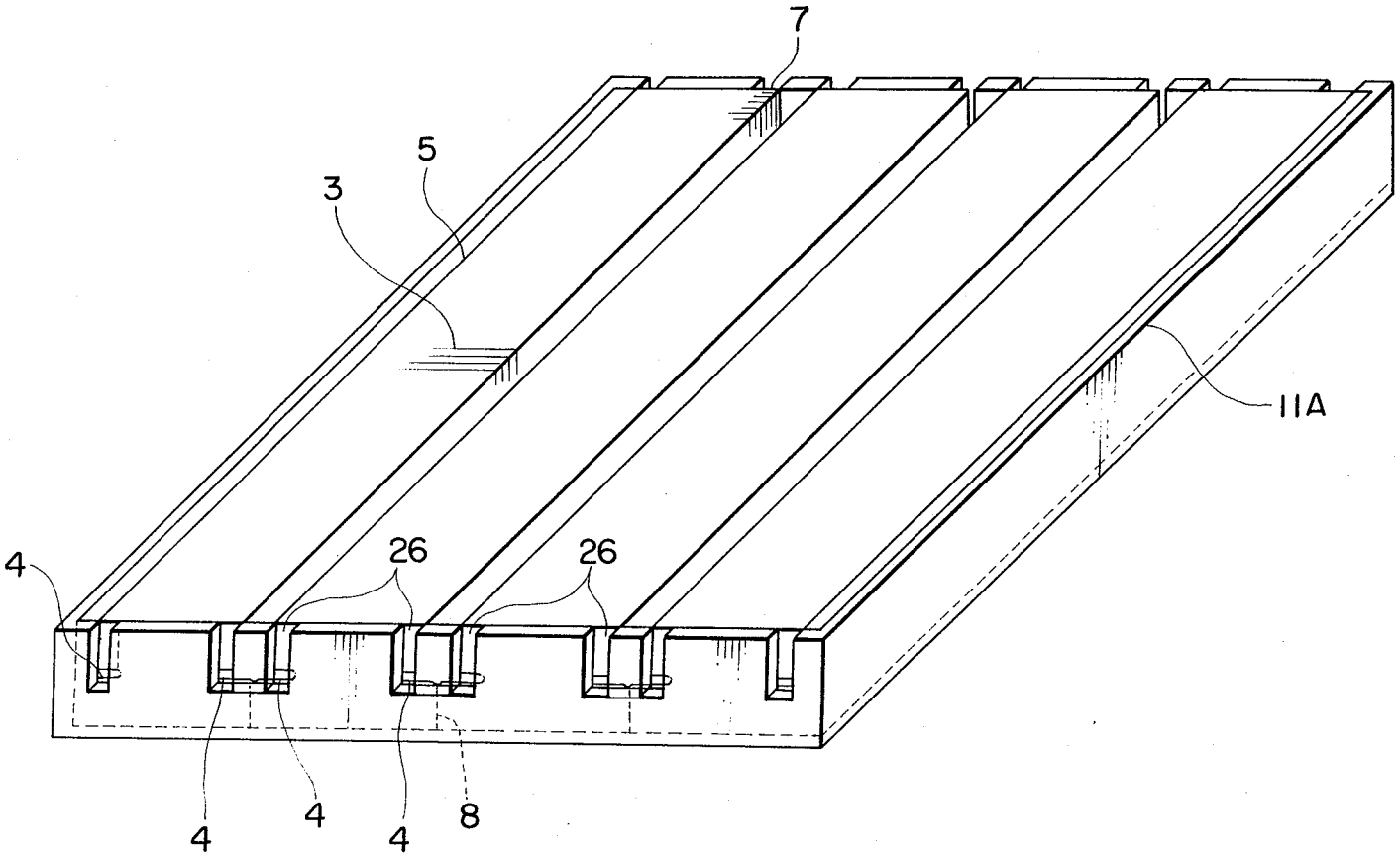
FIG. 1 is an oblique view of cartons placed in a carton packing case used for the method of the first embodiment according to this invention.

First, as shown in FIG. 1, every 200 to 250 collapsible cartons 3 are lined up with the shorter flap 7 facing upward and longer flap 8 facing downward in one direction, multiple rows of said collapsible cartons 3 are arranged in contact with other between rows at least on the same plane in one layer and in the packing case 11, and the handling fork member is inserted into the gap 4 between the shorter flap 7 and longer flap 8 of each row so as to lift each row of the arranged cartons from both ends. It is necessary that the above-described pair of fork members are inserted from one end into a recess formed at the gap 4 between both flaps so as to receive the top of the gap (recess) of one row of the said collected and lined-up cartons from both sides and raise the cartons surely. It is also necessary that all of the cartons are raised positively and placed at the right position so that any carton near both ends of each row is not left behind, or falls down. For that purpose, it is necessary that the pushing member 44 is applied at both ends of the row of the cartons to bring the cartons together towards the center of their row and the whole row of the said cartons is held sufficiently by the above-described fork member at the correct position.

For that purpose, the fork member 48 should be desirably as long as possible. It is necessary therefore to provide a slit (notch) 26 to accept the pushing member 44 and fork member 48 in the carton lining-up direction of the carton packing case 11A.

Figure 2:
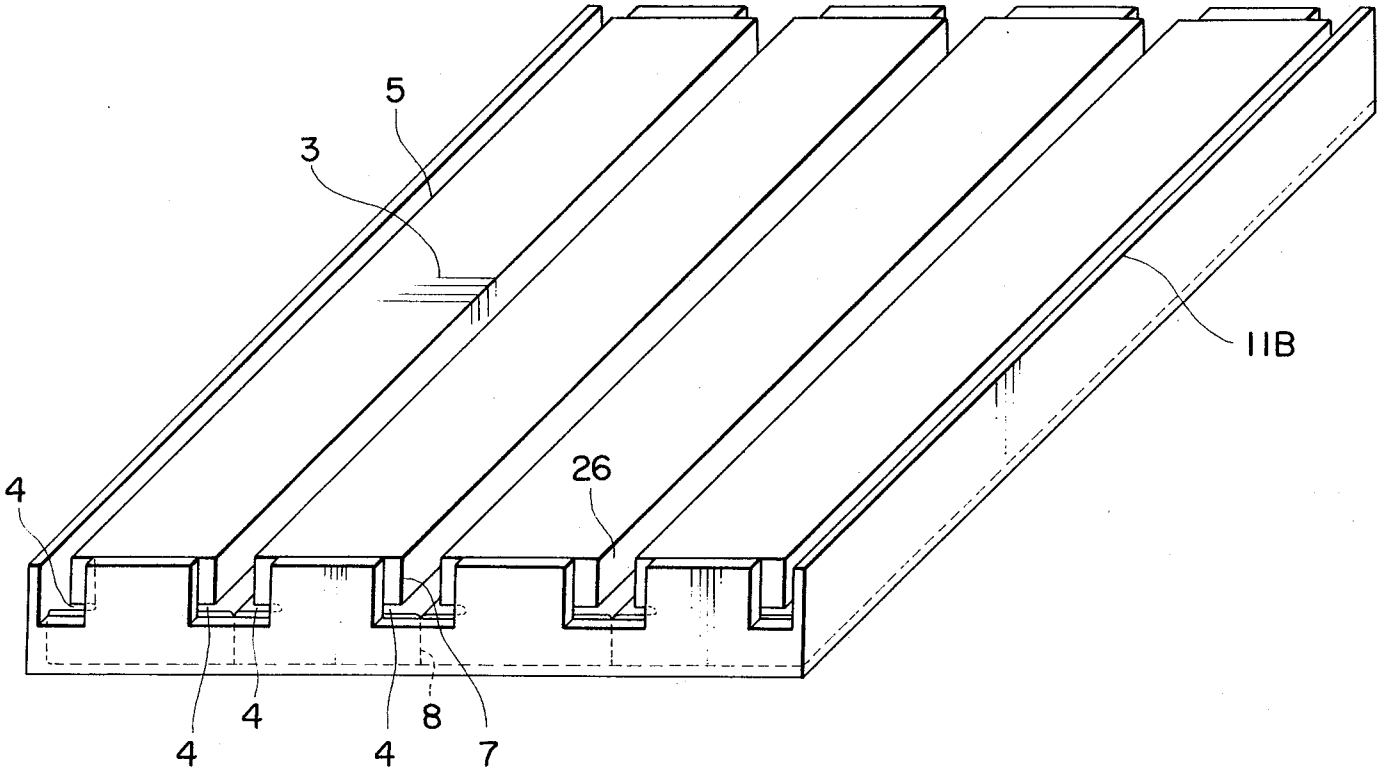
FIG. 2 is an oblique view of another carton packing case used for the method of the first embodiment according to this invention.
Figure 3:
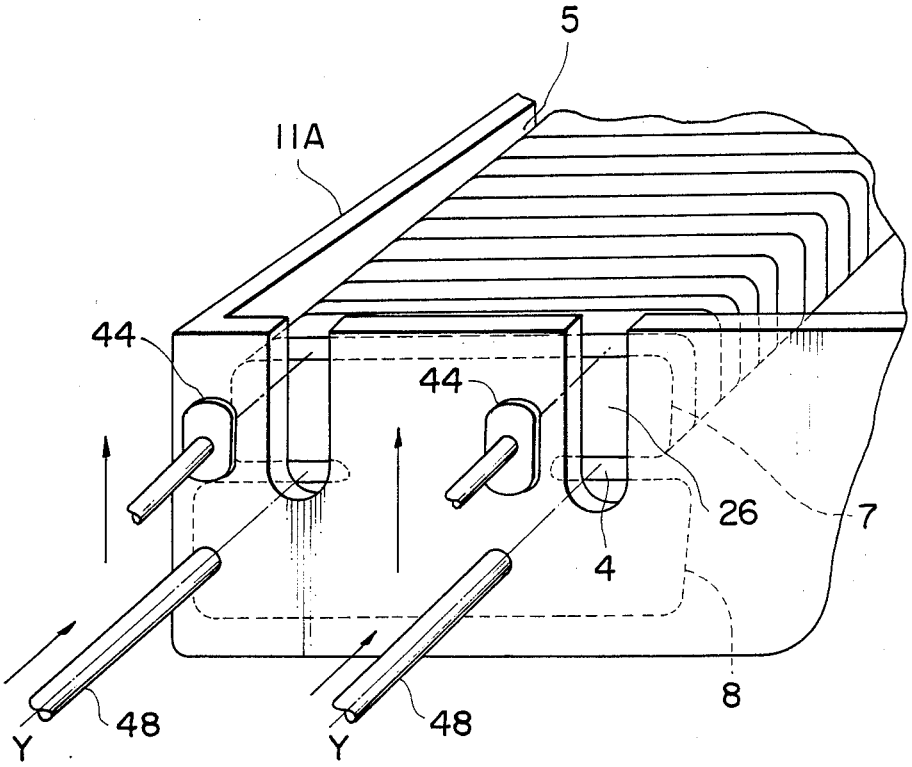
FIG. 3 is an oblique view showing the relation between the pushing member, fork member and cartons in the first embodiment.

In the packing case 11A in FIG. 1, above-described slit (notch) 26 is provided at the required 8 positions, while in the packing case 11B in FIG. 2, some slits are made in one larger notch of the slit at reduced 5 positions. Both slits in FIGS. 1 and 2 function in the same way but the one in FIG. 1 has a more complicated configuration however, it is slightly stronger than the other.

It is designed so that while the fork members 48 are inserted into the gap (recess) of the above-described carton row, a pair of pushing member 44 provided right above the fork member, penetrating the above-described slit in the same direction as the fork member and enabling to push the end of the carton row pushes properly the lined up cartons. By providing the functions of such fork member 48 and pushing member 44, the lifting function movable in the up and down directions, and the function to rotate around the vertical axis to the block carrying the above-described members, it becomes easy to establish a handling apparatus which enables the said block to move between any established positions in the horizontal direction.

However, the former is more desirable from the point of view of complete dust-proof package.

In this embodiment, the shorter carton flap is positioned upward and the longer one downward but they may be positioned inversely. In any case, since longer flaps are lined up with a very thin partition inserted between them, and the longer flaps on one side of a row of cartons positioned at the end of the carton packing case are in contact with the inside surface of the said packing case, it is possible to restrict the volume of the carton packing case to the required minimum. It becomes also possible that the above-described fork member 48 can be inserted easily into the upper and lower gap 4 to the flaps 7 and 8, a pair of pushing member 44 can enter the slit (notch) 26 easily, pushes both ends of the cartons positively so that the cartons can be handled with anybody attending when loaded to a cartoning machine while the cartons are prevented from falling down completely when raised by the above-described fork 48.

There ore, the carton packing case used for the method of this embodiment is very efficient.

The vertical gap 4 between the longer and shorter flaps should desirably be as large as possible.

The second embodiment using the method of this invention will be described below referring to FIGS. 4–17.

Figure 4:
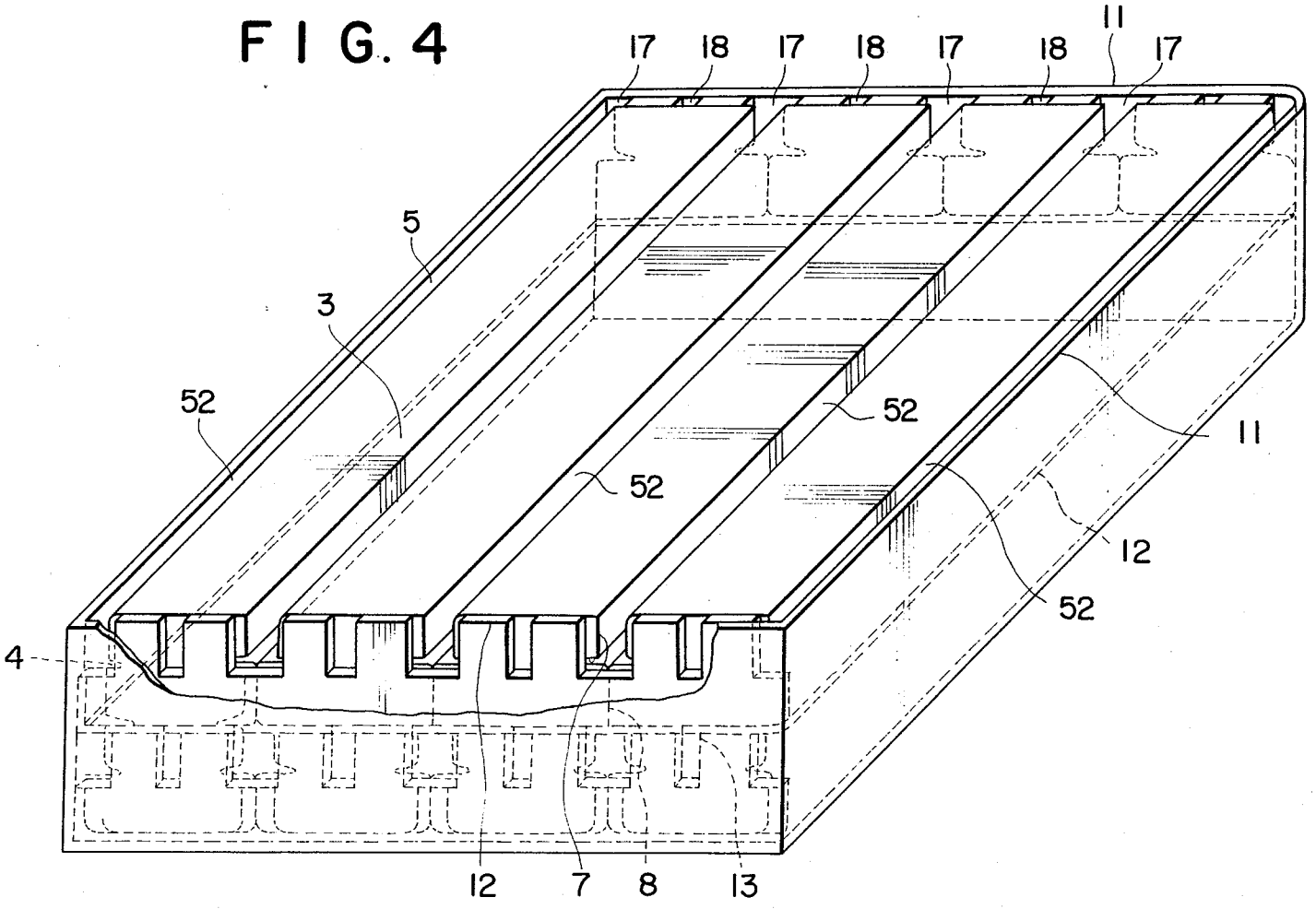
FIG. 4 is an oblique view showing the condition of cartons enhoused in a carton packing case used for the method of the second embodiment.

As shown in FIG. 4, every 200 to 250 collapsible cartons 3 are lined up in one direction with the shorter flap 7 facing upward and the longer flap 8 downward, multiple rows of the said collapsible cartons 3 are placed in a packing case 11 arranged in layers in contact with each other for at least one level, and a handling chuck member is inserted into a gap 52 between the shorter flaps 7 of each row or between the packing case wall and shorter flap 7 of the row at the end. It is required to bring the top of the above-described chuck member bent in an L-shape from both sides so as to insert it into the recess formed by the gap 4 between the vertical shorter and longer flaps of the cartons and hold and grasp one row of the said collected and lined up cartons from both sides. At the same time, it is necessary that cartons near both ends of each row are not left behind when they are grasped. For that purpose, it is necessary that the pushing member is applied to both ends of a row of cartons so as to bring cartons towards the center in the lining up direction and the entire row of the said cartons are sufficiently held by the above-described chuck member.

For that purpose, the chuck member should be desirable as long as possible. Therefore, gap 18 to accept the pushing member 44 and spacer 13 to make gap 14 to accept both ends 41*a* and 41*b* of the chuck member 41 are necessary to be on the inside of the carton packing case 11 in the carton lining up direction. Or positive chucking is also possible without using such a spacer to provide the gap 17 by previously pushing the cartons with the pushing member sufficiently to the center.

Figure 5:
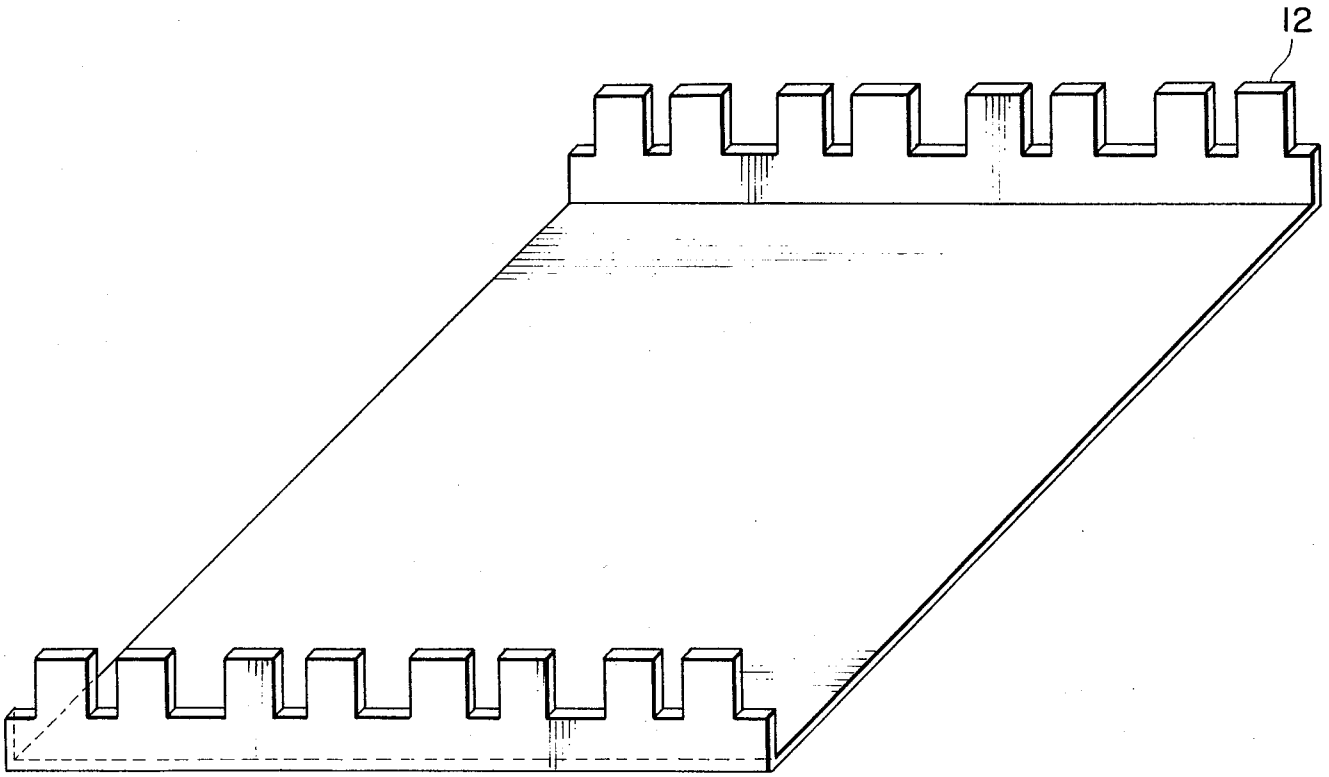
FIG. 5 is an oblique view of the spacer of the packing case used for the method of the second embodiment according to this invention.
Figure 6:
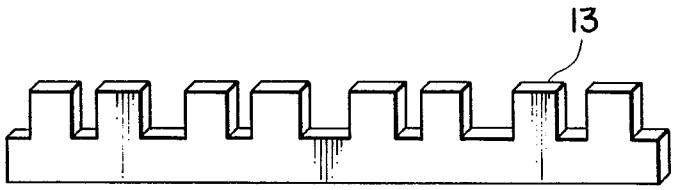
FIG. 6 is an oblique view of another spacer used for the method of the second embodiment according to this invention.

As for the spacer, a spacer 12 bent in U-shape as shown in FIG. 5 may be used one each for the lower and upper layers or as shown in FIG. 4, said U-shaped spacer 12 may be placed on the upper layer and spacer 13 as shown in FIG. 6 on both sides of the lower layer or the said spacer may be sticked to the inside wall of the case 11.

Figure 7:
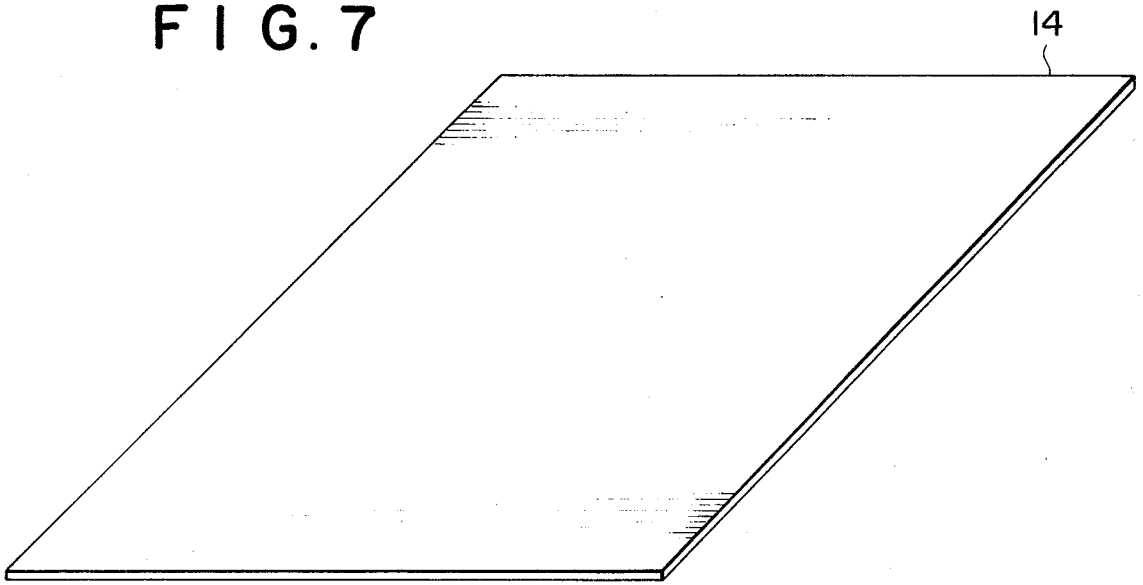
FIG. 7 is an oblique view of another spacer used for the method of the second embodiment according to this invention.

It is also permissible to use a spacer 13 as shown in FIG. 6 instead of the U-shaped spacer 12 in FIG. 5; and after packing cartons to the lower layer, the partition board 14 is placed as shown in FIG. 7 on the cartons of the lower layer and the same spacer 13 for the upper layer is used as that it is used for the lower layer. The spacer 13 may be pasted to the inside of the packing case 11 or just inserted between the carton 3 at the end of the carton row 5 and the inside of the packing case 11.

Figure 8:
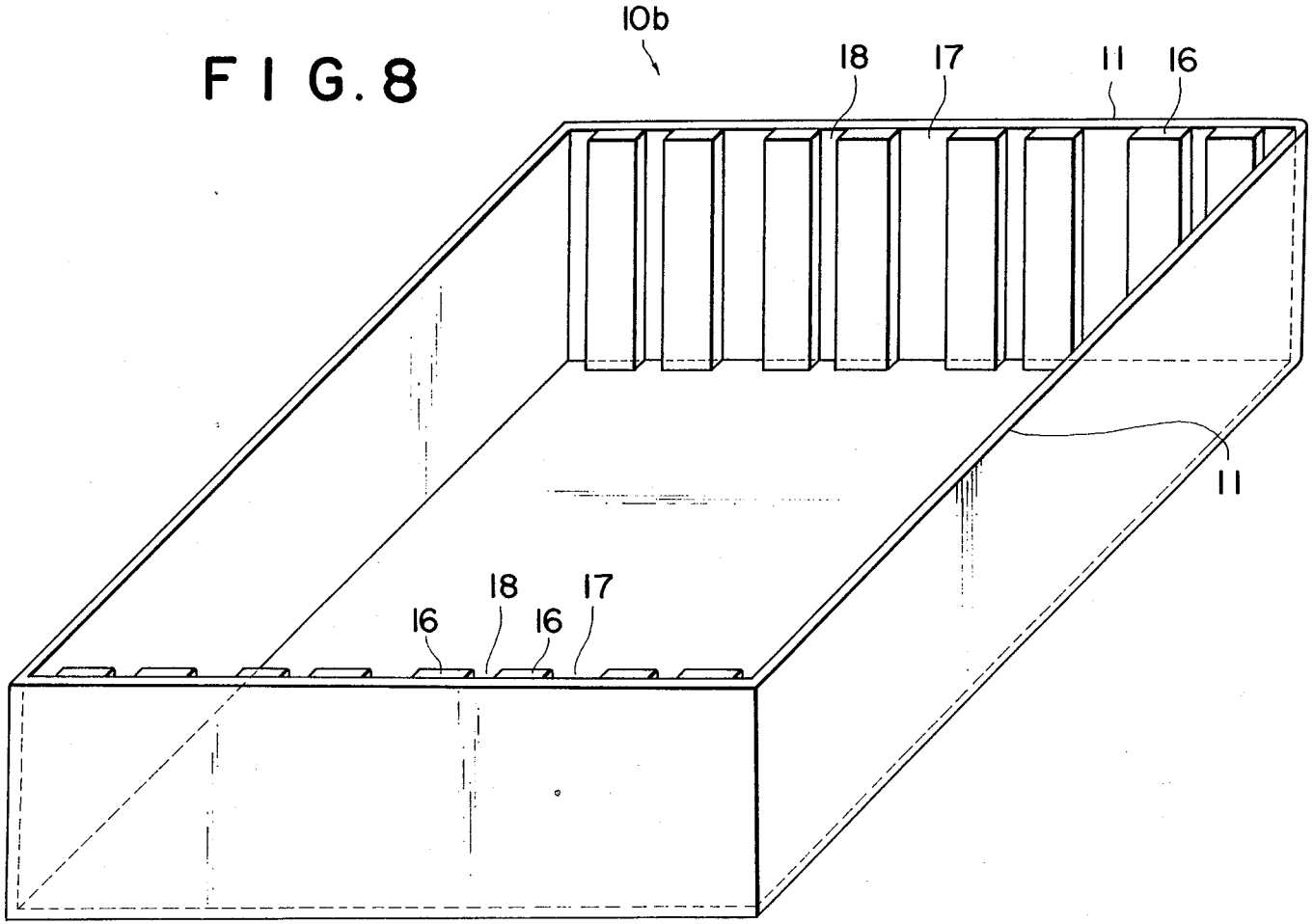
FIG. 8 is an oblique view of another carton packing case used for the second embodiment according to this invention.

Or as shown in FIG. 8, a method of sticking the spacer 16 to the inside of the packing case 11 in order to provide gaps 17 and 18 is also permissible. In this case, placing a partition board 14 on the border of the upper and lower layers is necessary.

Figure 11A:
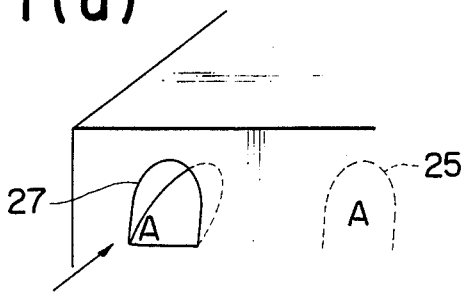
FIG. 11 (*a*) and (*b*) show windows for the pushing bar used for the method of the second embodiment according to this invention.
Figure 11B:
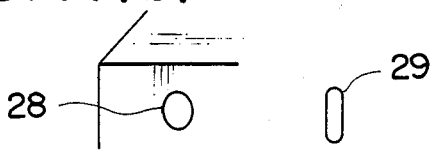

Such a method is also available that, as shown in FIG. 11 (*a*), without providing a spacer, perforations 25 are provided at both ends of the carton packing case 11 in the carton lining up direction, other pushing bar 46, which is desirably provided with a roller 47 to prevent from giving scratches and other damages to cartons, is bumped against the said perforations, to form an opened window as shown in FIG. 11 (*a*); the inside carton row is pushed from the end to form the gap between the carton row and inside of the carton packing case 11; the above-described pushing member 44 is inserted into the said gap; the carton row end is further pushed towards the center of the row; and the chuck member 41 is inserted into the recess 4 of the gap between flaps from both sides to grasp the lined up carton row positively without leaving anything behind.

As for the opening window 27, perforations may be provided as shown in FIG. 11 (*a*), or round hole 28 or long hole 29 may be drilled beforehand as shown in FIG. 11 (*b*). However, the former is more desirable from the standpoint of complete dust-proof packaging.

Figure 9:
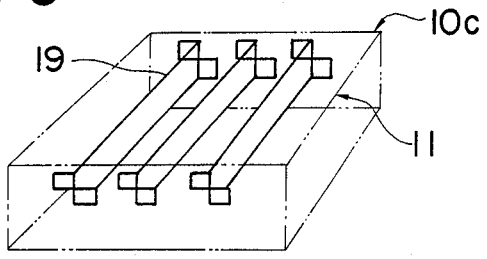
FIG. 9 is an oblique view of another carton packing case used for the method of the second embodiment according to this invention.

As for the spacer, as shown in FIG. 9, spacer 19, formed by cutting both ends almost along the center line, of rectangular thick paper which is bent the cut ends to opposing sides may be used. In this case, the bent ends may be adhered to the inside of the packing case 11 when cartons are in one layer; but when they are piped up in 2 layers, the bent ends of the upper layer should be just folded.

In such case, most of the rectangular paper between carton rows functions as a partition wall between carton rows.

Figure 10:
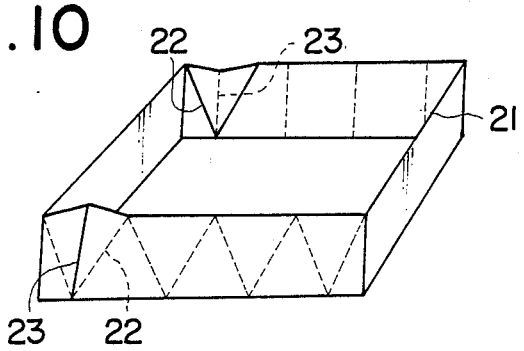
FIG. 10 is an oblique view of still another carton packing case used for the method of the second embodiment.

As a device to obtain the space effect, as shown in FIG. 10, space effect can be obtained by making perforations alternately on the front and back sides of the surface of the carton packing case which both end surfaces of the carton in the lining up direction are faced, and forming irregularities on the front or back side of the carton packing case along the perforations.

In this embodiment, by packing 200 to 250 cartons compactly in a carton packing case in the collecting direction with positioning the longer carton flap upside and the longer one downside so that longer flaps are brought into contact with those of next layer; or even though by packing them roughly with positioning the cartons of each row kept in a proper row by providing a very thin partition board between flaps, the cartons are kept out of being mixed with or disturbed by each other. Since the longer flap on one side of a carton row at the end in the carton packing case is in contact with the inside surface of the packing case, the volume of the carton packing case may be very small as a whole to the required minimum. The above-described chuck member may be easily inserted into the gap of the shorter flap. However, when cartons are turned upside down inversely to this case, thick and large partition spacers of the number of the carton rows should be provided in the packing case to provide the gap between longer flaps; thus, it is resulting in undesirable larger volume, complicated form and increased weight.

Therefore, the carton packing case used for the method of the second embodiment are very effective as in the first embodiment.

Figure 16A:
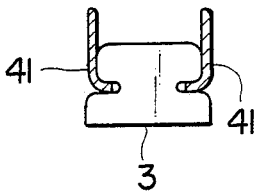
FIG. 16 (*a*) and (*b*) are front views showing the relation between the chuck member and cartons of the second embodiment.
Figure 16B:
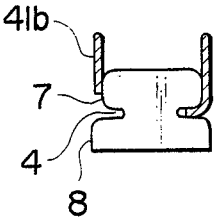

The chuck member 41 is bent in an L-shape at its end, which may be inserted into the recess between the longer and shorter flaps from both sides to grasp the cartons as shown in FIG. 16 (*a*) or one side of the chuck member may be flat chuck member 41*b* as shown in FIG. 16 (*b*). The applicant of this invention has confirmed that cartons may be grasped positively by either one of above methods.

Figure 12:
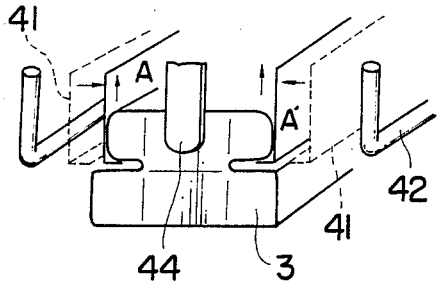
FIG. 12 is an oblique view showing the relation between the pushing member, chuck member and cartons in the second embodiment.
Figure 13:
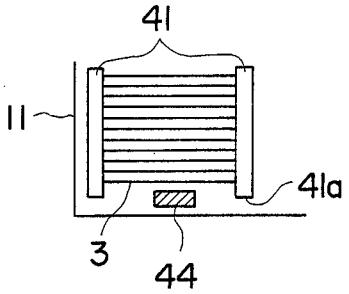
FIG. 13 is a plan view of FIG. 12.
Figure 14:
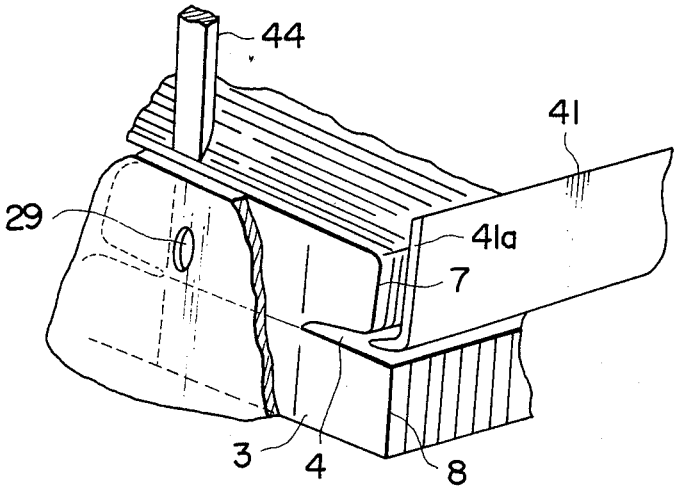
FIG. 14 is an oblique view showing the relation between the pushing member, pushing bar hole in the carton packing case, chuck member and cartons.
Figure 15:
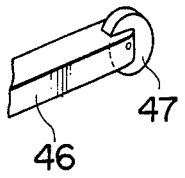
FIG. 15 is a partial oblique view of the pushing bar of the second embodiment.

As for the chuck member, a bar member 42 bent to U-shape as shown in the oblique view in FIG. 12 may be used.

In this case, however, the vertical gap 4 between longer and shorter flaps should desirably be relatively large. The main body of the carton packing case of the first and second embodiments has been described so far. In either embodiment, after cartons are packed into the packing case, a cover is applied and the joints between are sealed, or more simply, paper, plastic or other sheet may be covered and sealed, by which the damage, change in quality or other accidents of important packing materials during transportation can be prevented.

The packing case may be such that the cover is combined with the main body so that its one side shares one ridgeline with the main body of the case and can be opened or closed with the said ridgeline as the supporting axis. In this case, however, a device to retain the return of the cover after unsealing so as not to interfere with handling in the carton row is necessary.

When cartons are supplied to a cartoning machine after transportation, the above described seal may be torn and cartons may be placed at a specified position and handled as it is being placed in the packing case 11. As for the handling method of the first embodiment, as shown in the oblique view in FIG. 3, the pushing member 44 is pushed in the carton lining up direction, that is in the Y direction. When handling packages of a small number of cartons like a package of special package film below 1000 pieces, it is designed that the length between a pair of pushing members in the Y direction can be freely adjusted. Since carton packing cases used for the method of this embodiment are provided with a slit (notch) to insert a fork member 48 or pushing member 44, collecting up more than 2 layers is possible; however, it is not so desirable in one packing case since the slit length becomes larger. Consequently, packing cases as shown in FIGS. 1 and 2 are desirable for packing cases used for the method of this invention.

Figure 17:
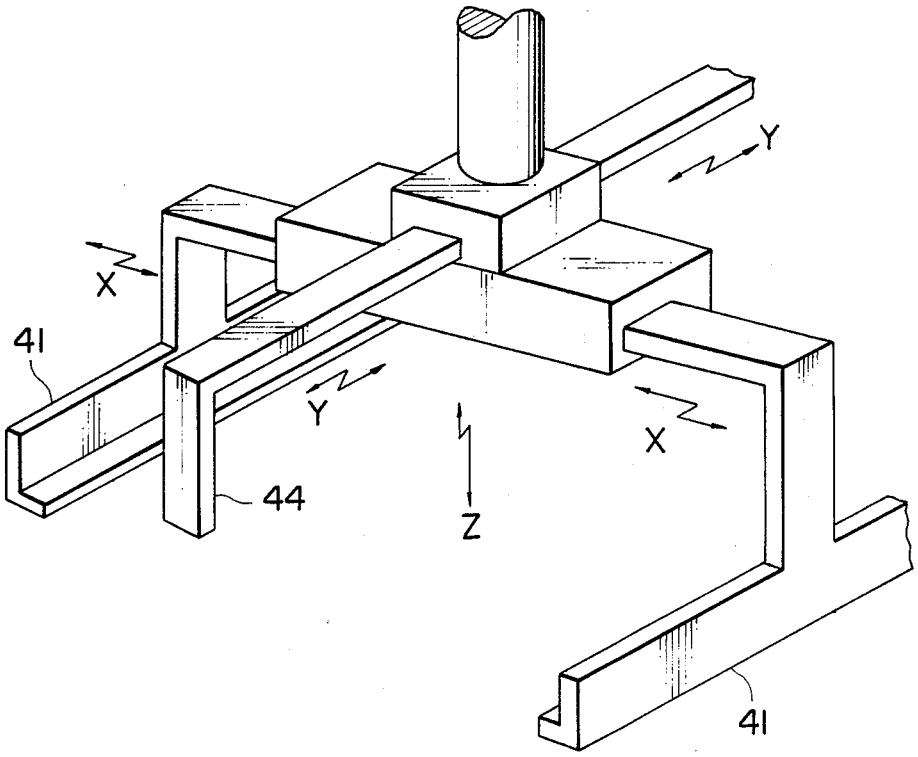
FIG. 17 is a functional explanatory diagram of the handling apparatus of the second embodiment.
Figure 18:
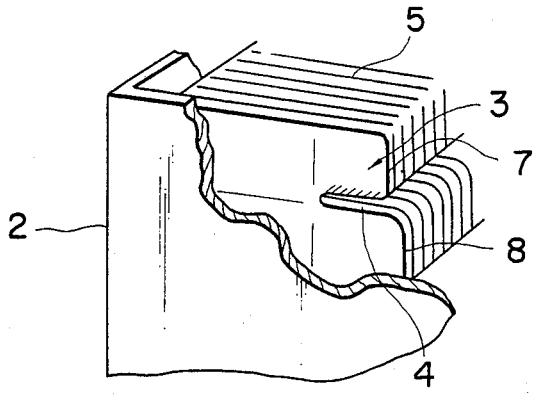
FIG. 18 PRIOR ART
FIG. 18 is an oblique view of the cartons enhoused in a former packing case.
Figure 19:
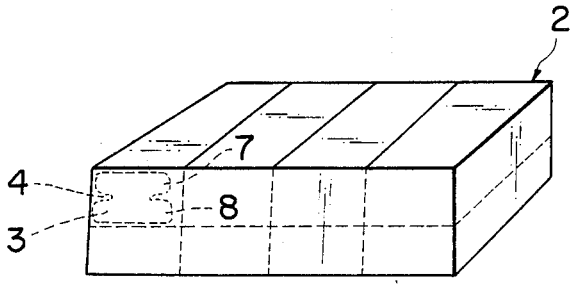
FIG. 19 PRIOR ART
FIG. 19 is a general oblique view of a former carton packing case.

As for the handling method of the second embodiment, as shown in the oblique view in FIG. 17, the pushing member 44 is pushed in the carton lining up direction, that is in the Y direction. It is designed that, for instance, when handling packaging of a small number of cartons such as the package of special package film of less than 1000 pieces, the length between the pair of pushing members in the Y direction can be easily adjusted. It is designed that, when no spacer is used for the packing case, the pushing bar 46 corresponding to the opening such as the opening window 27, round hole 28, and long hole 29 pushes the end of the carton row, the pushing member receives it and pushes further the said carton row, and at that time, the said pushing bar is returned to the original position. In other words, the pushing bar 46 is incorporated into the handling apparatus so as to be operated in the Y direction.

The chuck member 41 is designed to be movable to grasp the carton row in the grasping direction X.

It is designed so that the handling apparatus is movable up and down in the Z direction when lifting up the carton rows. In addition, it will be convenient to locate after transportation to design this handling apparatus so as to rotate around the Z axis.

It is clear that grasping up carton rows one by one from the position where carton packing cases are loaded and carrying and supplying them positively to the carton loading position for and packaging by the method of these embodiment are easily realized by incorporating the method according to this invention for a robot or other handling apparatuses.

This invention has enabled to supply cartons positively and stably to a high-speed packing machine by loading cartons packed in a corrugated cardboard at a specified position and unpacking it without using containers of complicated shape and large volume, enabled to save personnel to supply cartons for operation of the high-speed packing machines, and contributed greatly to more efficient packing processes. Since no special containers such as a reciprocating box are not used, it also contributes largely to improvement of productivity of transportation and reduction of production cost.

What is claimed is:

1. The method of supplying a plurality of cartons to a carton-packaging machine, comprising the steps of providing a plurality of flatened cartons stacked on edge in a line in a package so that two cutouts on each of said cartons are lined to form two grooves on two parallel sides of said stack;

inserting two bar-shaped means into said grooves respectively in the stacking direction of said cartons;

pressing said cartons to be together along the inserting direction of said bar-shaped means by a plurality of pressing means, being adjustable for different numbers of stacked cartons, so that the cartons are placed at the central portion of said bar-shaped means;

pulling out said cartons from said package with said bar-shaped means; and supplying said cartons to said carton-packaging machine with said bar-shaped means.

* * * * *

UNITED STATES PATENT AND TRADEMARK OFFICE

CERTIFICATE OF CORRECTION

PATENT NO. : 4,943,206

DATED : July 24, 1990

INVENTOR(S) : Masao Watanabe et al.

It is certified that error appears in the above-identified patent and that said Letters Patent is hereby corrected as shown below:

Claim 1, Column 8, Line 5, "The" should be --A--.

Signed and Sealed this

Fifteenth Day of September, 1992

*Attest:*

DOUGLAS B. COMER

*Attesting Officer*

*Acting Commissioner of Patents and Trademarks*